US006571584B1

(12) United States Patent
Okayama

(10) Patent No.: US 6,571,584 B1
(45) Date of Patent: Jun. 3, 2003

(54) BINDING OFF METHOD EXCELLENT IN STRETCHABILITY

(75) Inventor: Yasutaka Okayama, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/030,082

(22) PCT Filed: Jul. 5, 2000

(86) PCT No.: PCT/JP00/04504

§ 371 (c)(1),
(2), (4) Date: Jan. 11, 2002

(87) PCT Pub. No.: WO01/04398

PCT Pub. Date: Jan. 18, 2001

(30) Foreign Application Priority Data

Jul. 13, 1999 (JP) ..... 11-199128

(51) Int. Cl.[7] ..... D04B 1/24
(52) U.S. Cl. ..... 66/64; 66/176
(58) Field of Search ..... 66/69, 176, 179, 66/172 R, 169 R, 169 A, 170, 171, 75.1, 89

(56) References Cited

U.S. PATENT DOCUMENTS 4,548,057 A 10/1985 Stoll
5,271,249 A * 12/1993 Mitsumoto et al. ..... 66/172 R
5,456,096 A * 10/1995 Mitsumoto et al. ..... 66/172 R
5,669,244 A * 9/1997 Okuno ..... 66/172 R
5,836,177 A * 11/1998 Okuno et al. ..... 66/176
6,070,438 A * 6/2000 Okuno et al. ..... 66/172 R
6,119,050 A * 9/2000 Okuno et al. ..... 66/64

FOREIGN PATENT DOCUMENTS

JP A-9-310254 A 12/1997
JP A-10-204759 A 8/1998
JP A-10-245751 A 9/1998

* cited by examiner

*Primary Examiner*—Danny Worrell
(74) *Attorney, Agent, or Firm*—Rothwell, Figg, Ernst & Manbeck

(57) ABSTRACT

When binding off loops are formed in the process of a binding off process, intermediate wale loops, which are formed with the needles located between downstream wale loops and upstream wale loops of the binding off loops, are formed with the number of courses twice as much as wale loops between the downstream wale loops and those between the upstream wale loops. This can provide the result that when a force acts on the knitted fabric, the yarn is drawn out from the intermediate wale loops to enlarge the downstream wale loops and the upstream wale loops. This can allow the bound off part of the knitted fabric to have an excellent stretchability.

3 Claims, 12 Drawing Sheets

BINDING OFF METHOD EXCELLENT IN STRETCHABILITY

CROSS REFERENCE TO RELATED APPLICATION

This application is a 35 USC 371 National Phase Entry Application from PCT/JP00/04504, filed Jul. 5, 2000, and designating the U.S.

TECHNICAL FIELD

The present invention relates to a binding off method for casting off to prevent loosening of stitches at an end of a knitted fabric in the process of knitting by using a flat knitting machine, which method is particularly suitable for use in binding off at the part of the knitted fabric that wants stretch.

BACKGROUND ART

There has been proposed a knitting method of knitting a knitted fabric which is called an integral garment, wherein when knitting by use of a flat knitting machine, the knitted fabric is finished by binding off to prevent loosening of stitches at the end thereof or by knitting into a desired form, so as to simplify the tail end process after knitting of the knitted fabric. Also, there have been proposed a variety of further advanced knitting methods of a knitting a knitted fabric which is called a seamlessly knitted fabric, wherein the knitted fabric is knitted in the form of a nearly completed product on the flat knitting machine, so as to practically eliminate the need of the tail end process such as the sewing operation. Taking the method of knitting a sweater 1 shown in FIG. 1 as an example, a knitting method of the seamlessly knitted fabric will be described. The sweater 1 starts in knitting from ribbed hems 9 of front and back bodies 3, 5 and from cuffs 11*a*, 11*b* of left and right sleeves 7*a*, 7*b* and is gradually shaped while the front and back bodies 3, 5 and the sleeves 7*a*, 7*b* are knitted toward their respective sides at which they start to be joined to each other. At the respective sides of the sweater, the left and right sleeves are shifted toward their respective bodies 3, 5 and then are joined thereto. After the front and back bodies 3, 5 and the sleeves 7*a*, 7*b* are joined, the loops in the final courses of the front and back bodies 3, 5 are joined at the shoulder lines 17*a*, 17*b*. Finally, the neck 13 is formed. In this manner, the sweater 1 is knitted in the form of a seamlessly knitted fabric that requires no substantial tail end process. The final course of the neck of the sweater 1 is cast off in a knitting manner that is called the binding off process. The binding off process is the process in which a loop in the final course of the knitted fabric is laid over the next to form a double loop; then a loop of the next course is formed on the double loop; further the newly formed loop is laid over the next to form a loop of the next course; and this knitting is repeatedly performed from one side of the knitted fabric to the other side thereof, whereby the loops of the final course of the knitted fabric are cast off.

Referring now to FIG. 11 showing a knitting course diagram and FIG. 12 showing the looping of the knitted fabric that was subjected to the binding off process by the knitting shown in FIG. 11, a conventional binding off method will be described. The course 0 of FIG. 11 shows the state of a tubular knitted fabric before binding off process in which a front knitted fabric portion 201 held on needles B, D, F, . . . and a back knitted fabric portion 203 held on needles a, c, e, . . . are continuously connected at both ends thereof. In the course 1 of FIG. 11, a yarn is fed to needles T, R to form loops 211, 213 subsequent to loops in the final course of the knitted fabric and, then, a yarn feeder 915 is shifted rightward. Thereafter, in the course 2, the loops 211, 213 at the needles T, R are transferred to a back bed. In the course 3, those loops are transferred further to needles P, R, so that a double loop is formed with a loop 221 in the final course of the knitted fabric at the needle P. In the course the yarn is fed to the needles R, P to form loops 215, 217 of the next course. In this manner, the number of loops held on the needles decreases by one loop from the number of loops of the course 0. The knitting shown in the courses 1 to 3 is repeatedly performed, proceeding to the left to which the binding off process proceeds, to finish the binding off process of the front knitted fabric portion 201. Thereafter, the knitting is repeatedly performed, proceeding reversely from the left to the right, to finish the binding off process of the back knitted fabric portion 203.

When undergoing the binding off process mentioned above, the knitted fabric comes into the state shown in FIG. 12 (which shows only a part of the front knitted fabric portion 201 around the location at which the binding off process is started). Of the loops formed in the course 1 and the course 4, the loops 213, 217 formed to the left, which is the same direction as the proceeding direction of the binding off process, are laid over loops 221, 223 of the final course of the knitted fabric in an intersecting relation, so as to extend from the starting point of the binding off process to the termination point. Likewise, the loops 211, 215 formed to the right, which is the opposite direction to the proceeding direction of the binding off process, are also laid in an intersecting relation to the loops of the final course of the knitted fabric, so as to extend in parallel with the loops 213, 217. The loops that are laid over the loops in the final course of the knitted fabric in the intersecting relation to the loops 221, 223 in the final course of the knitted fabric so that the adjoining loops in the final course of the knitted fabric are connected to each other, like the loops 213, 217, and the loops that are formed in the process of the biding off process, to extend along the final course of the knitted fabric, like the loops 211, 215 that are formed in parallel with the loops 213, 217, are both referred to as "the binding-off loop" in the following description. The binding-off loops that are formed in double wale are referred to as "double binding-off loops", and the binding-off loops that are formed in triple wale are referred to as "triple binding-off loops".

In the integral garment or the seamlessly knitted fabric, the fabric knitted on the flat knitting machine is directly presented in the form of a part of the knitted product. Accordingly, the fabric is required to be knitted so as to have the requirements for each part of the knit goods, such as stetchability, toughness and good appearance. When wearing the sweater 1 mentioned above, the neck 13 it often stretched out under the action force. If the neck 13 is poor in stretch, there arise the problems that when wearing the sweater, a thread breakage is caused to produce snag stretch or the neck 13 is overstretched to be visually undesirable. In the case of the knitted fabric that was subjected to the conventional binding off process illustrated in FIGS. 11 and 12, when it is stretched in a horizontal direction under the action force, the loops 211, 213 and the loops 217, 225, which are connected to the loops 219, 221, 223 in the final course of the knitted fabric, are both simultaneously strained horizontally, so that they cannot be stretched any further. Thus, the conventional binding off method fails to provide sufficient stretch for the part of the knitted fabric that wants high stretch, such as the neck 13, thus providing the disadvantages that the thread breakage is caused and that it is hard for one's head to insert through the neck 13.

To try to solve the problems, there has been proposed a binding off method in which in the step between the completion of the knitting of the course 1 of FIG. 11 and the start of the knitting of the course 2 of FIG. 11, the yarn is fed to the needles R, T in the process of the shift of the yarn feeder 95 to the right side, so that each time when two courses of binding-off loops are formed, they are laid over the loops in the final course. However, this binding off method has the problem that since the knitted fabric subjected to this binding off process comes to have an increased number of courses of binding-off loops, even when no force acts on the knitted fabric, the bound off part is stretched out and slackened, or the spaces between the loops in the final course of the knitted fabric are widened as if they appear to be in holes. The present invention aims to disclose a novel binding off method that can provide an excellent stretchability such that when a force acts on the knitted fabric, the bound off part is fully stretched, while on the other hand, when no force acts thereon, it is contracted closely.

DISCLOSURE OF THE INVENTION

In the light of the problems mentioned above, the present invention provides a novel binding off method, excellent in stretchability, to bind off in knitting an end of a knitted fabric by use of a flat knitting machine comprising at least a pair of front and back needle beds, either or both of which are structured to be racked horizontally. The method comprises:

(a) the step that except a needle holding thereon a wale loop, located upstream of a proceeding direction of a binding off process, of the wale loops which are to be formed into binding off loops in a final course of a knitted fabric to be subjected to the binding off process, a yarn is fed to the remaining needles holding the wale loops thereon in the proceeding direction of the binding off process, to form a first course of binding off loops, (b) the step that a yarn feeder is reversed and, except the needle holding thereon a wale loop, located downstream of the proceeding direction of the binding off process, of the wale loops which are to be formed into the binding off loops, the yarn is fed to the remaining needles in an opposite direction to the proceeding direction of the binding off process, to form the next course of binding off loops, (c) the step that the binding off loops formed in the step (a) and the step (b) are shifted to the proceeding direction of the binding off process and are laid over the loops in the final course of the knitted fabric adjoining to the binding off loops of the wale located downstream of the proceeding direction of the binding off process, to form a double loop, and (d) the step that the knitting of the steps (a) to (c) are repeatedly performed to the loops in the final course of the knitted fabric located in the proceeding direction of the binding off process. According to this constitution of the present invention, the intermediate wale loops formed between the downstream wale loops and the upstream wale loops are allowed to have the number of courses twice as much as the downstream wale loops and the upstream wale loops. As a result of this, the cross-over yarn connecting between the downstream wale loops and the intermediate wale loops comes to crossover the intermediate wale loops which are formed in the different courses. Likewise, the cross-over yarn connecting between the upstream wale loops and the intermediate wale loops comes to cross over the intermediate wale loops which are formed in the different courses.

In the binding off method above, in advance of the form of intermediate wale loops of the binding off loops from which downstream wale loops and upstream wale loops are excluded, the intermediate wale loops are transferred to an opposed needle bed, and loops of the next course are formed in the form of the back stitches on the opposed needle bed and then are transferred back to the original needle bed, whereby at least one course of intermediate wale loops are formed in the form of the back stitches, which is one of the characteristic features of the present invention. According to this constitution of the present invention, the cross-over yarn connecting between the downstream wale loop formed in the form of the front stitch and the intermediate wale loops formed in the form of the back stitches and between the upstream wale loop formed in the form of the front stitch and the intermediate wale loop formed in the form of the back stitch comes to increase in length, as compared with the case where the intermediate wale loops are knitted in the form of the front stitches.

Also, the present invention provides a novel method of binding off in knitting an end of a knitted fabric by use of a flat knitting machine comprising at least a pair of front and back needle beds, at least one of which is structured to be racked horizontally, the method comprises:

(a) the step that a yarn is fed to two adjoining wale loops in a final course of a knitted fabric to be subjected to a binding off process in accordance with a proceeding direction of the binding off process, to form a first course of binding off loops, (b) the step that a yarn feeder is reversed and a bonding off loop of the next course is formed at a wale loop located upstream of the proceeding direction of the binding off process, (c) the step that the binding off loops formed in the step (a) and the step (b) are shifted to the proceeding direction of the binding off process and the wale loop located downstream of the proceeding direction of the binding off process is laid over the adjoining loop in the final course of the knitted fabric, to form a double loop, and (d) the step that the knitting of the steps (a) to (c) are repeatedly performed to the loops in the final course of the knitted fabric located in the proceeding direction of the binding off process. According to this constitution of the present invention, the upstream wale loops are allowed to have the number of courses twice as much as the downstream wale loops. As a result of this, a pair of cross-over yarns connecting between the downstream wale loops and the upstream wale loops comes to cross over the upstream wale loops which are formed in the different courses.

BEST MODE FOR CARRYING OUT THE INVENTION

Figure 1:
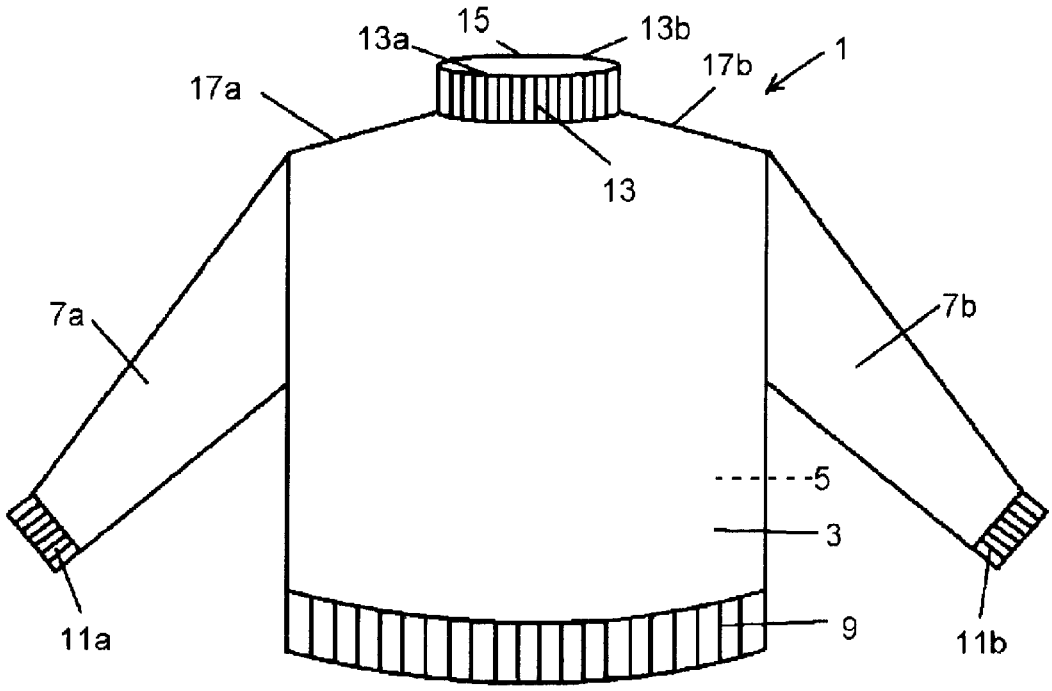
FIG. 1 shows a sweater 1 that was subjected to the binding off process of the present invention.

Taking the process in which the final course 15 of the neck 13 of the sweater 1 of FIG. 1 is bound off as an example, certain preferred embodiments of the present invention will be described below. For the sake of facilitation of explanation, description is given of the case where the knitting is performed by use of just a few needles much smaller in number than those used for the practical knitting. Although reference is given to the binding off process for a tubular knitted fabric formed by a front knitted fabric portion 13*a* and a back knitted fabric portion 13*b* being continuously connected at both ends thereof, the embodiments of the present invention are not limited to the binding off process for the tubular knitted fabric.

The binding off method of the present invention can be used with a flat knitting machine comprising at least a pair of front and back needle beds, either of which is structured to be racked in the longitudinal direction. In the following description, a two-bed flat knitting machine is used, which comprises the pair of front and back needle beds and is so structured that the back needle bed can be racked in the longitudinal direction. In the embodiments of the present invention, in order for the loops to be transferred in the process of the tubular knitting on the two-bed flat knitting machine, even needles are used for knitting a front knitted fabric portion, odd needles are used for knitting a back knitted fabric portion, and alternate needles are used for the knitting, wherein only either of the paired front and back knitting needles are used for holding the loops to be knitted, while empty needles for the transference of loops are reserved on the opposed needle bed. In the case where a flat knitting machine including upper beds which are disposed over a pair of lower beds and on which transferring components, such as transfer jacks or needles are arranged, is used, the tubular knitting can be performed without any empty needles being arranged between the knitting needles for use in forming the loops.

First Embodiment

Figure 2:
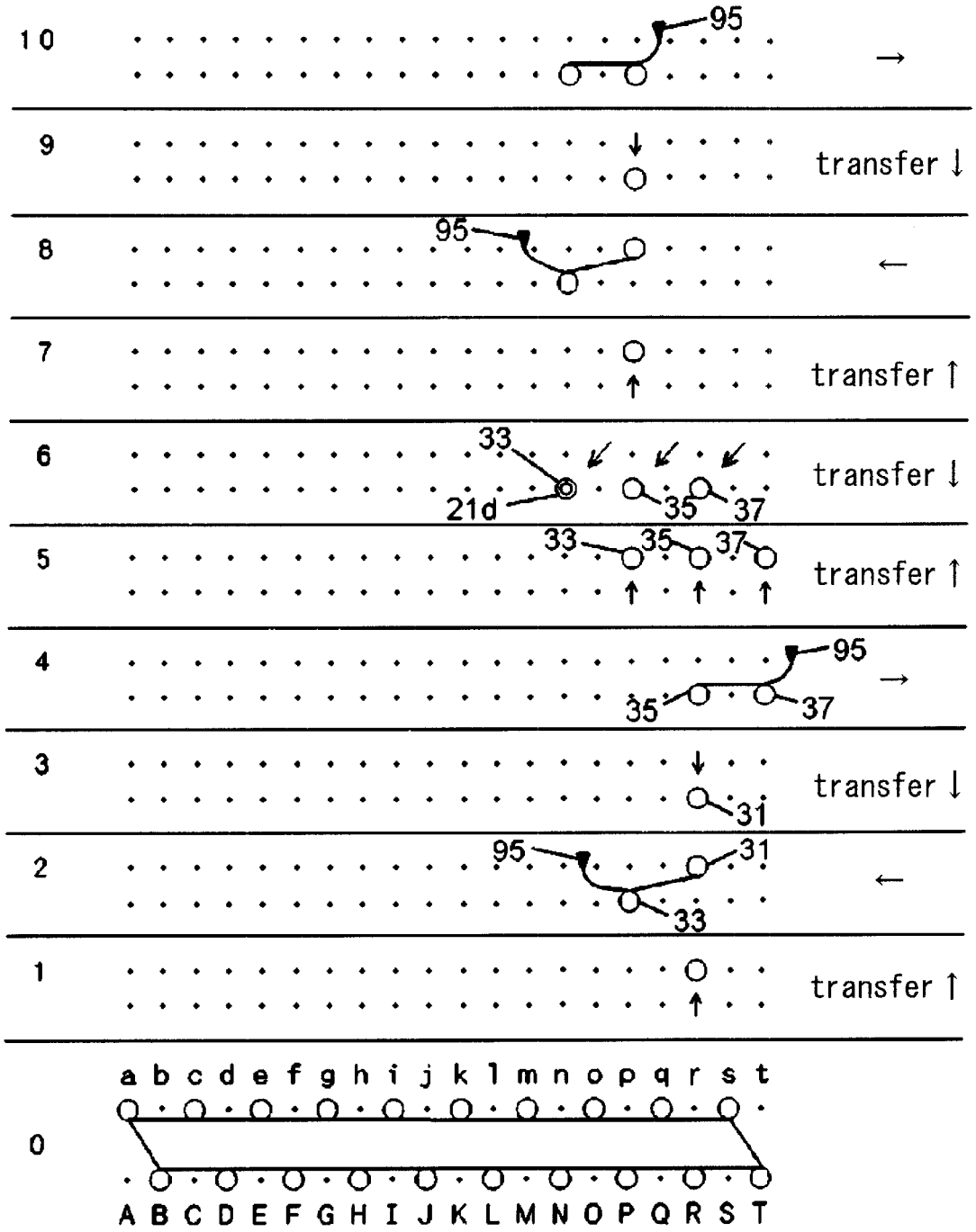
FIGS. 2–5 are knitting course diagrams illustrating the first embodiment of the present invention.

Description of the first embodiment of the present invention will be given. The course 0 of FIG. 2 shows the state that the knitting leading up to the neck 13 of the sweater 1 is completed, whereat the loops in the final course of the front knitted fabric portion 13a of the neck 13 are held on the alternate needles B, D, F, . . . of the front bed, and the loops in the final course of the back knitted fabric portion 13*b* are held on the alternate needles a, c, e, . . . of the back bed.

The binding off process of the neck 13 is started at the right end of the front knitted fabric portion 13*a*. After arriving at the left end of the front knitted fabric portion 13*a*, the binding off process proceeds from the left end of the back knitted fabric portion 13*b* toward the right end of the same. In the first embodiment, the triple binding-off process is performed in which the binding-off loops, which are formed in the course of the binding off process to extend along the final course of the knitted fabric in the direction of the wale of the knitted fabric in the intersecting relation to the loops of the final course of the knitted fabric, are formed with the needles used for three wale.

In the following description, of the triple wale, in which the binding-off loops are formed, the wale at a downstream-most location with respect to the proceeding direction of the binding off process is simply referred to as "the downstream wale", the wale at an upstream-most location is simply referred to as "the upstream wale", and the wale at the intermediate location between the downstream wale and the upstream wale is simply referred to as "the intermediate wale". In this embodiment, the binding off process starts at the needles P, R, T on the front bed, so that in the course 0, the downstream wale loop, the upstream wale loop, and the intermediate wale loop are held on the needle P, the needle T, and the needle R, respectively.

Figure 6:
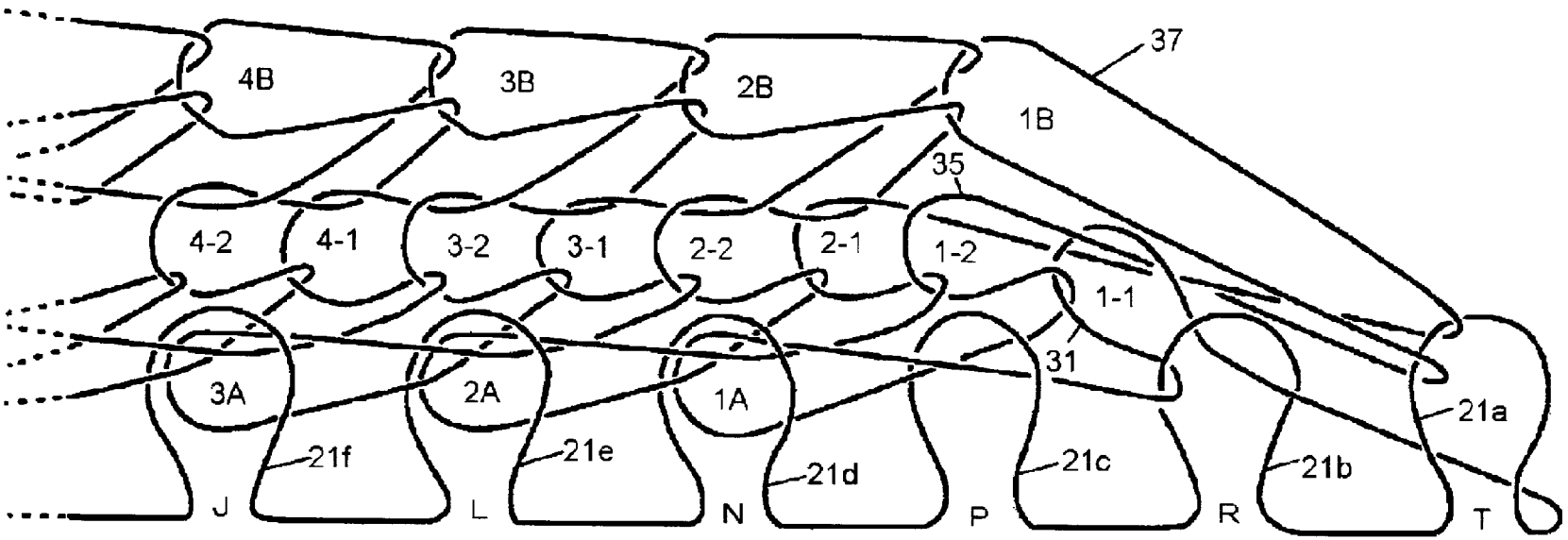
FIG. 6 is a looping diagram of the knitted fabric that was subjected to the binding off process of the first embodiment of the present invention.

Referring to the knitting course diagrams of FIGS. 2 to 5 and the looping diagram of FIG. 6, the description of the first embodiment is given. In FIGS. 2 to 5, the numerals at the left side indicate the serial number of the courses, the capital alphabetical letters indicate the needles on the front bed, and the small alphabetical letters indicate the needles on the back bed. The horizontal arrows indicate the direction for the yarn to be fed, and the vertical arrows indicate the direction for the loops to be transferred. FIG. 6 is the looping diagram of the knitted fabric that was subjected to the binding off process of the first embodiment (which however shows only a part of the front knitted fabric portion 13*a* around the location at which the binding off process is started). The binding-off loops are numbered to show the number of times required for the binding-off loop to be formed. The loops in the final course of the knitted fabric are marked by the needles (J, L, K, P, R, T) on which those loops are formed. 1A and 1B and 1-1 and 1-2 are the loops formed in the first binding off process illustrated in the courses 1-6. 1A denotes the downstream wale loop, 1*b* denotes the upstream wale loop. 1-1 denotes the intermediate wale loop formed in forward knitting, and 1-2 denotes the intermediate wale loop formed in backward knitting. Likewise, 2 to 4 indicate the loops formed in the 2nd to 4th binding off processes, respectively. 21*a*, 21*b*, 21*c*, 21*d*, 21*e* and 21*f* denote the loops in the final course of the knitted fabric formed with the needles T, R, P, N, L and J, respectively.

In the course 1 of FIG. 2, the loop at the needle R is transferred to the back bed. In the course 2, the knitting in which the yarn is fed to the direction for the binding off process to proceed (hereinafter it is referred to as "the forward knitting") is performed. Specifically, the yarn is fed to the needle r holding the intermediate wale loop thereon and to the needle P holding the downstream wale loop thereon by means of the yarn feeder 95, to form the binding-off loops 31, 33 thereat. Then, in the course 3, the loop 31 at the needle r is transferred to the needle R. In the course 4, the knitting in which the yarn is fed to the opposite direction to the direction for the binding off process to proceed (hereinafter it is referred to as "the backward knitting") is performed, whereby the binding-off loops 35, 37 are formed at the needle R and the needle T holding the upstream wale loop thereon, respectively.

In the first embodiment, the intermediate wale loops, into which two courses of loops are formed in a single binding off process, are presented in the form of a back stitch 31 in the forward knitting and a front stitch 35 in the backward knitting, respectively, which is the characteristic feature of the first embodiment. In the courses 5 and 6, the binding-off loops 33, 35 and 37 newly formed at the needles P, R and T in the knitting of the courses 2 and 4 are transferred to the needles N, P and R, respectively. As a result of this, the loop 21*d* in the final course of the knitted fabric and the binding-off loop 33 are held by the needle N. A series of knitting shown in the courses 1 to 6 is one batch of knitting required for one stitch loop of the final course of the knitted fabric to be bound off. In the courses 7 to 12 of FIGS. 2–3, the knitting shown in the courses 1–6 proceeds to the left to which the binding off process for the front knitted fabric portion 13*a* proceeds. As a result of the knitting noted above, the loops which were held on the needles T and R in the course 0 are taken off from the same needles.

Figure 3:
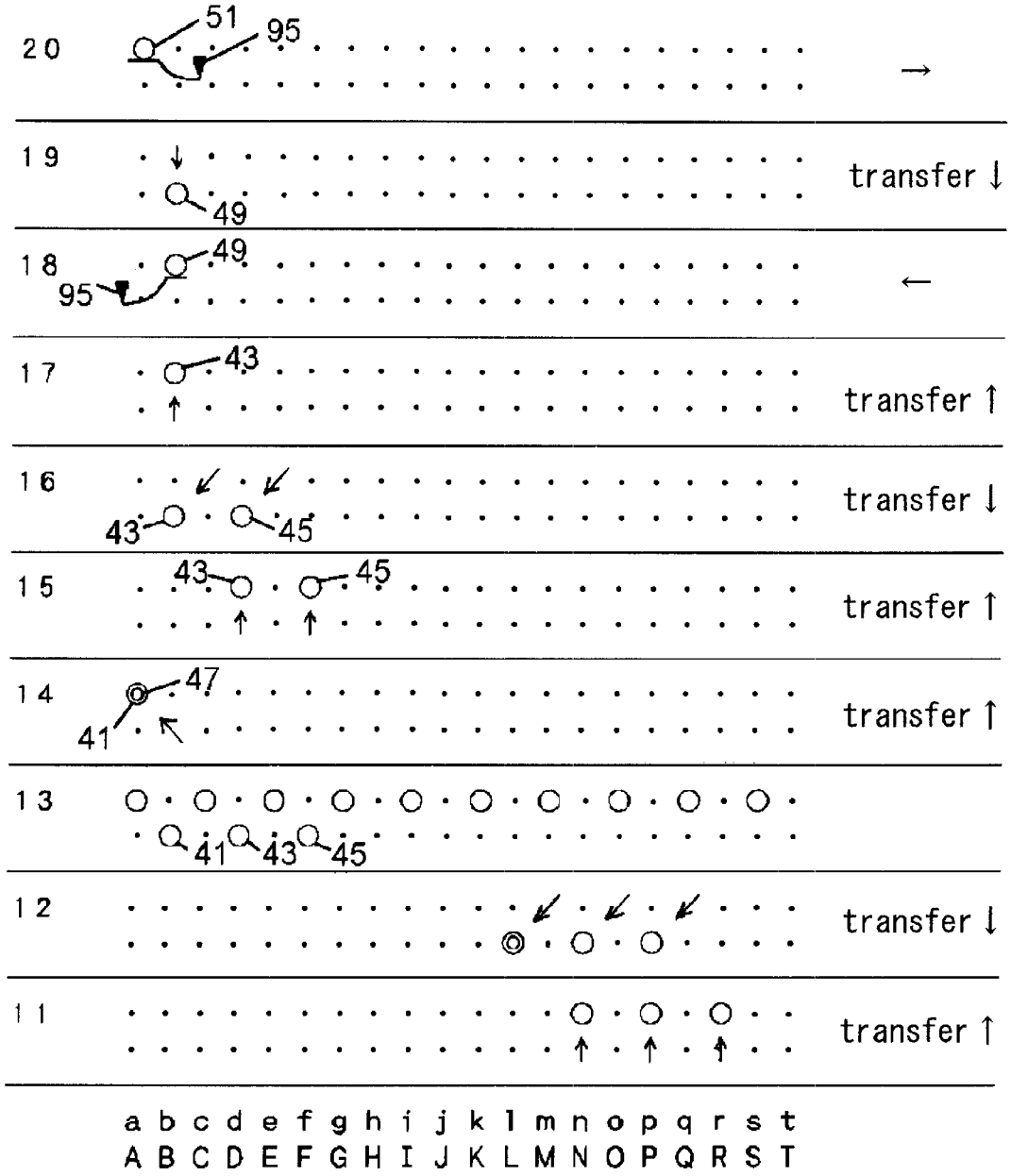

Next, from the course 13 of FIG. 3 onward, reference is given to the knitting at the location where the binding off process of the front knitted fabric portion 13*a* is transferred to the binding off process of the back knitted fabric portion 13*b*. The course 13 illustrates the state that after the binding off process is completed for the loops in the final course of the knitted fabric which were held on the needles H, J, L, N, P, R and T in the course 0 by the knitting shown in the courses 1 to 6 being repeatedly performed for the final course of the front knitted fabric portion 13*a*, the binding-off loops 41, 43 and 45 are held on the needles B, D and F only. The back knitted fabric portion 13*b* are subjected to the binding off process from the left to the right side. In the course 14, the loop 41 at the needle B, which is the downstream wale loop of the binding-off loops, is transferred to the needle a on the back bed and is laid over the loop 47 in the final course of the back knitted fabric portion 13*b*. Then, the remaining binding-off loops 43 and 45 held on the needles D and F are transferred to the needles d and f in the course 15 and then are transferred to the needles B and D in the course 16. This kitting corresponds to the knitting in the courses 5 and 6 of FIG. 2. In the course 17, in order to knit the intermediate wale loop in the form of the back stitch, the loop 43 at the needle B is transferred to the needle b. In the course 18, the yarn is fed to the needle b to form the binding-off loop 49 in the intermediate wale thereat. In the course 19, the loop at the needle b is transferred back to the needle B. In the course 20, the yarn is fed to the needle a to form the downstream wale loop 51 thereat. The knitting in the courses 17 to 20 corresponds to the knitting in the courses 1 to 3 of FIG. 2. Although the forward knitting is performed in the single course in the course 2, since the binding-off loops are symmetrically parted into the front and back needle beds at the location where the binding off process of the front knitted fabric portion 13*a* is transferred to the binding off process of the back knitted fabric portion 13*b*, the forward knitting is performed in two separate courses of the course 18 and the course 20, rather than in the single course.

Figure 4:
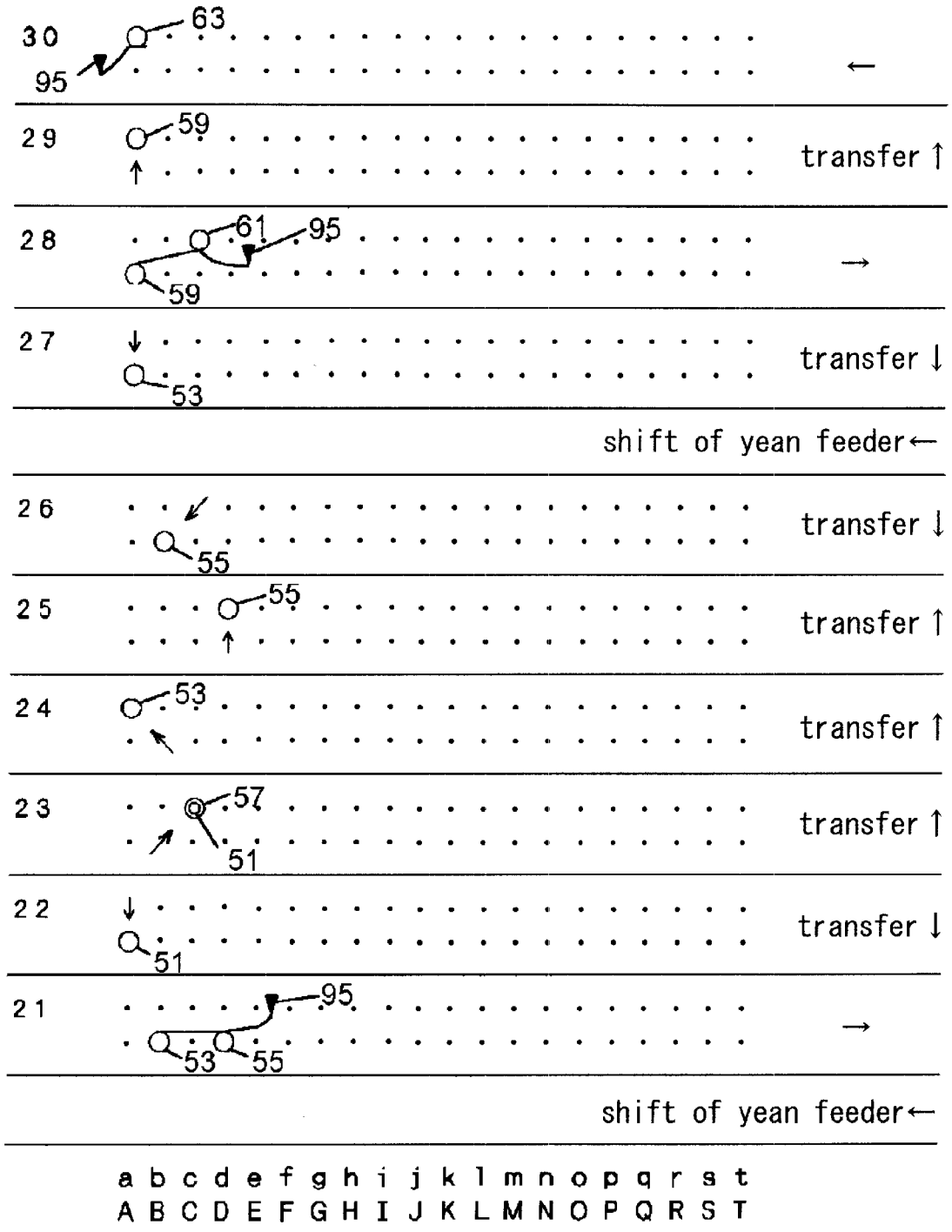
Figure 5:
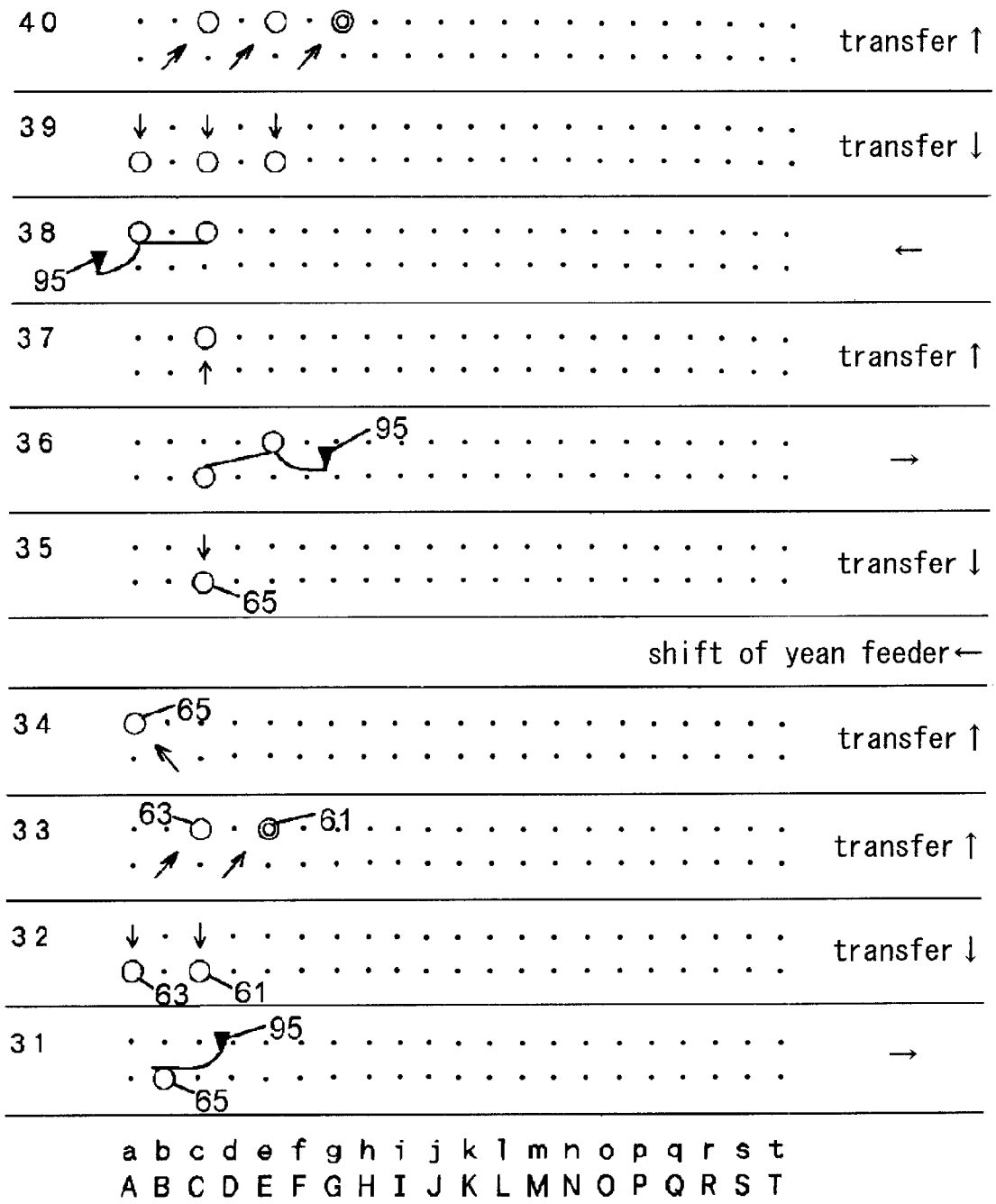

Then, in the course 21 of FIG. 4, after the yarn feeder 95 is shifted leftward, the yarn is fed to the needle B and the needle D to form the binding-off loops 53 and 55 thereat, thus performing the backward knitting corresponding to the course 4. In the course 22, the downstream wale loop 51 at the needle a is transferred to the needle A. Then, in the course 23, the downstream wale loop 51 is transferred to the needle c and is laid over the loop 57 in the final course of the back knitted fabric portion 13*b*. In the course 24, the intermediate wale loops 53 at the needle B is transferred to the needle a. In the course 25, the loop 55 at the needle D is transferred to the needle d and, then, in the course 26, it is transferred to the needle B. The knitting in the courses 22 to 26 corresponds to the knitting in the courses 5 and 6 of FIG. 2. After the yarn feeder 95 is shifted rightward, the loop 53 at the needle a is transferred to the needle A in the course 27, in order to form the intermediate wale loop in the form of the back stitch. In the course 28, the binding-off loops 59 and 61 are formed by the forward knitting in which the yarn is fed to the needle A holding the intermediate wale loop 53 thereon and to the needle c holding the upstream wale loop 51 thereon. In the course 29, the intermediate wale loop 59 is transferred back to the needle a. In the course 30, the yarn is fed to the needle a to form the intermediate wale loop 63. In the course 31 of FIG. 5, the backward knitting is performed in which the yarn is fed to the needle B holding the upstream wale loop 55 thereon to form the binding-off loop 65. In the courses 32 and 33, the binding-off loops 61 and 63 that were shifted toward the back knitted fabric portion 13*b* are shifted to the right to which the binding off process of the back knitted fabric portion 13*b* proceeds and are laid over the loop in the final course of the knitted fabric at the needle E. Then, in the course 34, the loop 65 at the needle B is transferred to the needle a, thus bringing the binding off process of all loops of the front knitted fabric portion 13*a* to completion. Sequentially, in the courses 35 to 40, the same knitting as the knitting in the courses 1 to 6 is performed to the right end to which the binding off process of the back knitted fabric portion 13*b* proceeds. Thereafter, the knitting shown in the courses 35 to 40 is repeatedly performed to the right end of the back knitted fabric portion 13*b* and thereby the loops of the back knitted fabric portion 13*b* are all bound off.

The knitted fabric as was subjected to the binding off process of the first embodiment comes into the state as shown in FIG. 6. Specifically, when no force acts on the knitted fabric, the intermediate wale loops 1-1, 1-2, 2-1, 2-2, 3-1 and 3-2, which are formed with the number of courses twice as much as the downstream wale loops 1A, 2A and 3A and the upstream wale loops 1B, 2B and 3B, are contracted more than common loops in order to be balanced with the downstream wale loops 1A, 2A and 3A and the upstream wale loops 1B, 2B and 3B. On the other hand, when force acts on the knitted fabric, the knitting yarn is drawn out from those intermediate wale loops 1-1, 1-2, 2-1, 2-2, 3-1 and 3-2 and the downstream wale loops 1A, 2A and 3A and the upstream wale loops 1B, 2B and 3B are enlarged, so that the stretchability of the knitted fabric is secured at the bound off portion.

In addition, in the embodiment, since the intermediate wale loops, two courses of which are formed in the single binding off process, are formed in parallel with the downstream wale loops 1A, 2A and 3A and upstream wale loops 1B, 2B and 3B, only one course of which are formed in the single binding off process, there are presented no such problem that the end of the knitted fabric is stretched out and slackened or that the spaces between the loops are widened as if they appear to be in holes, differently from the conventional binding off method mentioned above in which all wale loops are formed into two courses of wale loops in the single binding off process. Further, in the embodiment of the present invention, since the intermediate wale loops are formed in the form of the back stitches in the course in which the forward knitting is performed, the cross-over yarn between the adjoining loops comes to increase in length, as compared with the case where both of the intermediate wale loops are formed in the form of the front stitches, as the second embodiment as mentioned later, thus providing a superior stretchability.

Second Embodiment

Figure 7:
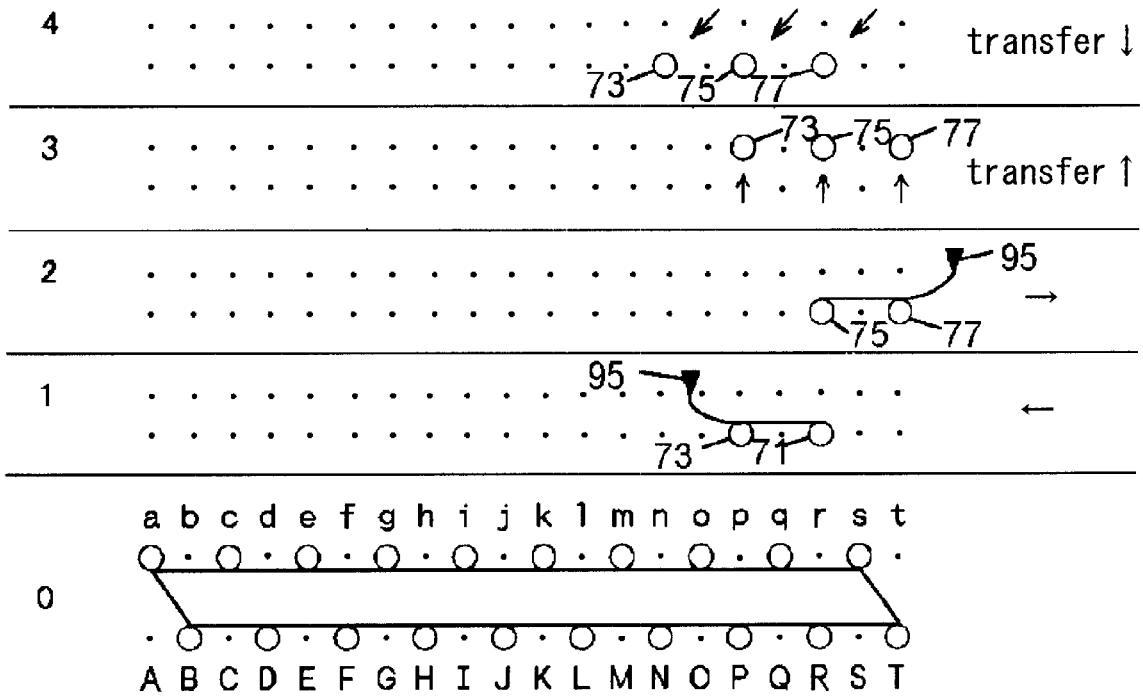
FIG. 7 is a knitting course diagram illustrating the second embodiment of the present invention.

Referring to FIG. 7, the description of the second embodiment will be given. The difference between the second embodiment and the first embodiment in that the intermediate wale loops are formed in the form of the front stitches in both of the forward knitting and the backward knitting. As the second embodiment is different from the first embodiment only in the forward knitting, the description is limited to that difference only and the description of the knitting sequent to the course 0 of the first embodiment will be given. The knitting of the courses 1 to 4 of FIG. 7 corresponds to the knitting of the courses 1 to 6 of the first embodiment. In the course 1 of the second embodiment, the yarn is fed to the needles R and P via the yarn feeder 95 to form the loops 71 and 73 thereat. In the course 2, the yarn feeder 95 is turned over and the yarn is fed therefrom to the needles R and T to form the loops 75 and 77 thereat. Then, in the courses 3 and 4, the binding-off loops 73, 75 and 77 formed in the courses 1 and 2 are transferred to the needles N, P and R. With this, the knitting of one binding off process is completed. The knitting shown in the courses 1 to 4 is repeatedly performed to achieve the binding off process. In the second embodiment, there is no need to transfer the loops between the front and back beds that was performed in the courses 1 and 3 of the first embodiment.

Third Embodiment

Figure 8:
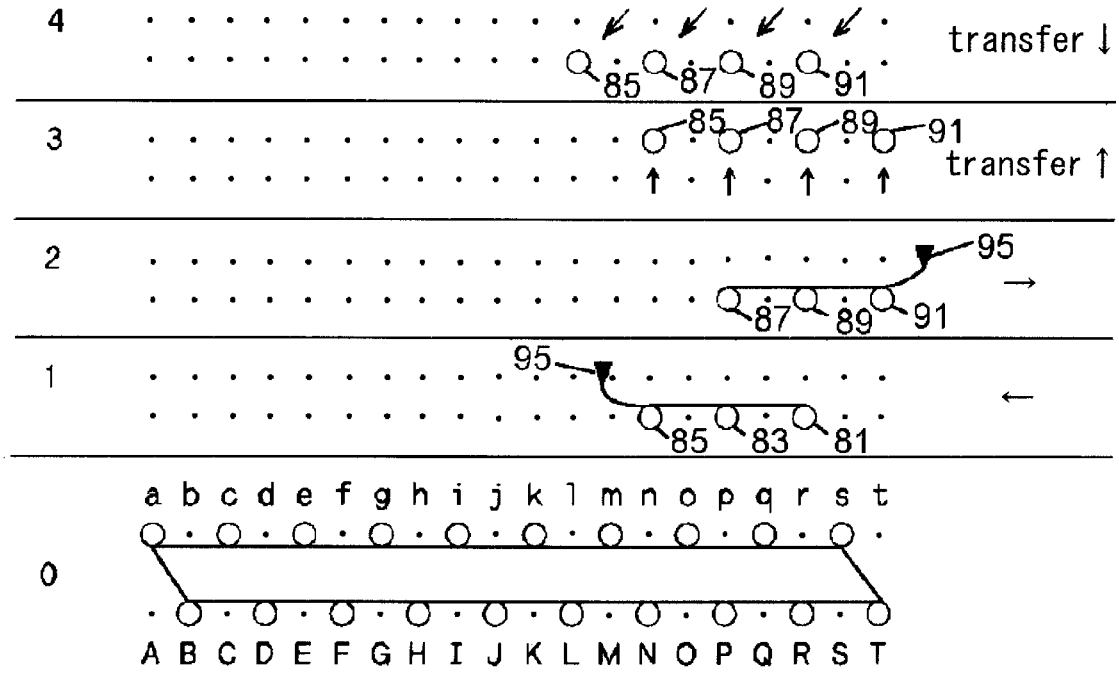
FIG. 8 is a knitting course diagram illustrating the third embodiment of the present invention.

Referring now to FIG. 8, the description of the third embodiment will be given. The third embodiment is an example in which the intermediate wale loops of the binding-off loops are further increased in number. Specifically, four-wale binding-off loops and two-wale intermediate wale loops are formed. The knitting of the courses 1 to 4 of FIG. 8 corresponds to the knitting of the courses 1 to 6 of the first embodiment. In the course 1, the yarn is fed to the needles R, P and N to form the loops 81, 83 and 85 thereat. In the course 2, the yarn is fed to the needles P, R and T to form the loops 87, 89 and 91 thereat. In the courses 3 and 4, the binding-off loops 85, 87, 89 and 91 at the needles N, P, R and T formed in the courses 1 and 2 are transferred to the needles L, N, P and R. With this, one binding off process is completed. Then, the knitting shown in the courses 1 to 4 is repeatedly performed to achieve the binding off process.

Fourth Embodiment

Figure 9:
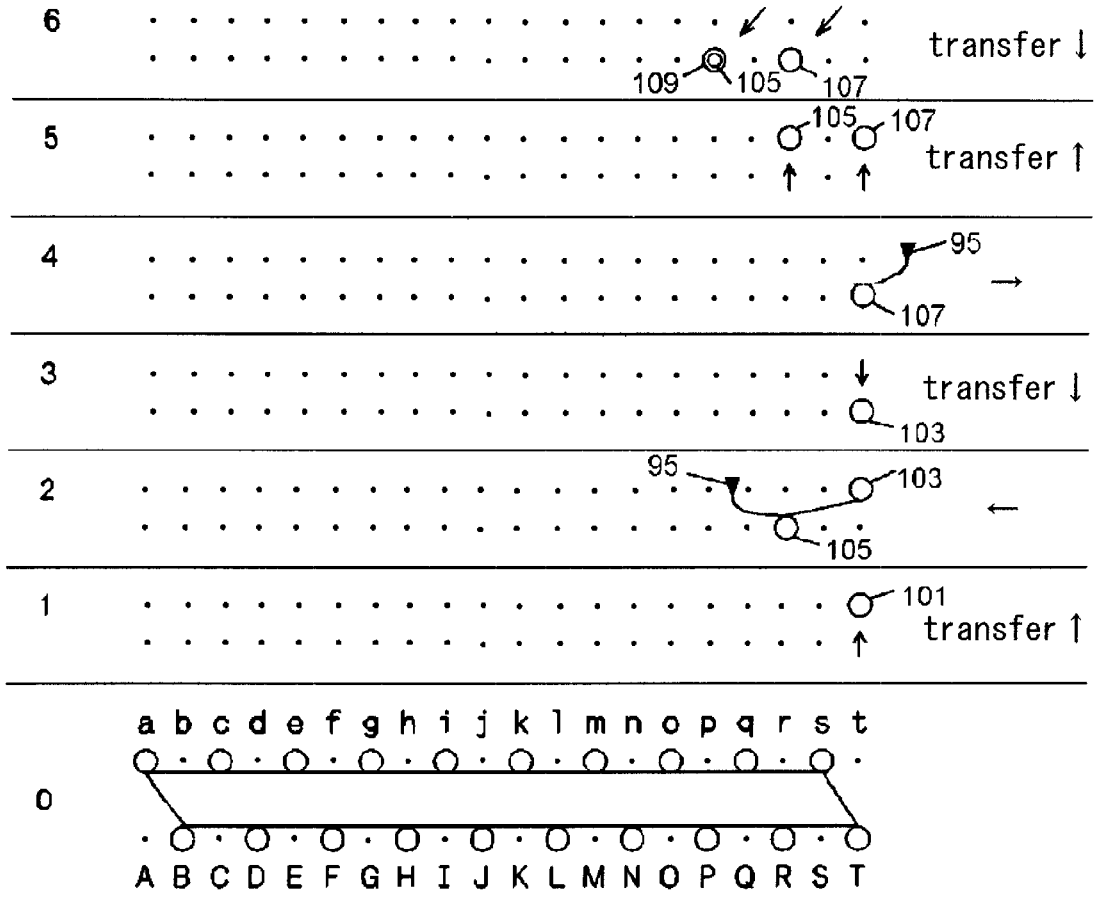
FIG. 9 is a knitting course diagram illustrating the fourth embodiment of the present invention.

Next, referring to FIGS. 9 and 10, the description of the fourth embodiment will be given. The fourth embodiment is an example in which the knitting at the upstream wale loops of the first embodiment is omitted. In the fourth embodiment wherein the two-wale binding-off loops are formed, the binding off loops are formed by a downstream wale loop formed downstream of the proceeding direction of the binding off process and an upstream wale loop formed upstream of the same. In the course 1 of FIG. 9, in order to form the upstream wale loop in the form of the back stitch, the loop 101 at the needle T is transferred to the needle t. In the course 2, the forward knitting is performed, whereby the yarn feeder 95 is shifted downstream of the proceeding direction of the binding off process and the yarn is fed to the needle t and the needle R to form the binding off loops 103 and 105 thereat. In the course 3, the loop at the needle t is transferred back to the needle T. Then, in the course 4, the backward knitting is performed, whereby the yarn feeder 95 is shifted rightward and the yarn is fed to the needle T to form the binding off loop 107. In the course 5, the loops 105 and 107 formed in the course 2 and the course 4 are transferred to the needles r and t. Then, in the course 6, they are transferred to the needles P and R, and the upstream wale loop 105 is laid over the loop 109 in the final course of the knitted fabric held on the needle P. Thereafter, the knitting shown in the courses 1 to 6 is repeatedly performed in the proceeding direction of the binding off process and thereby the loops in the final course of the knitted fabric are all bound off.

Figure 10:
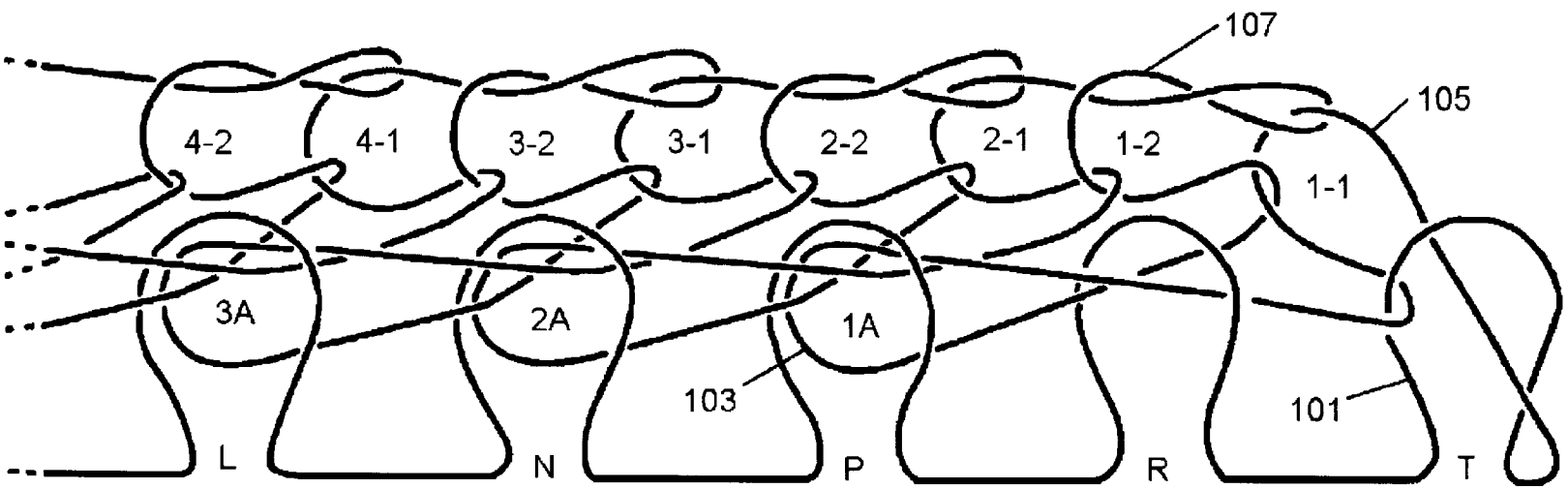
FIG. 10 is a looping diagram of the knitted fabric that was subjected to the binding off process of the fourth embodiment of the present invention.
Figure 11:
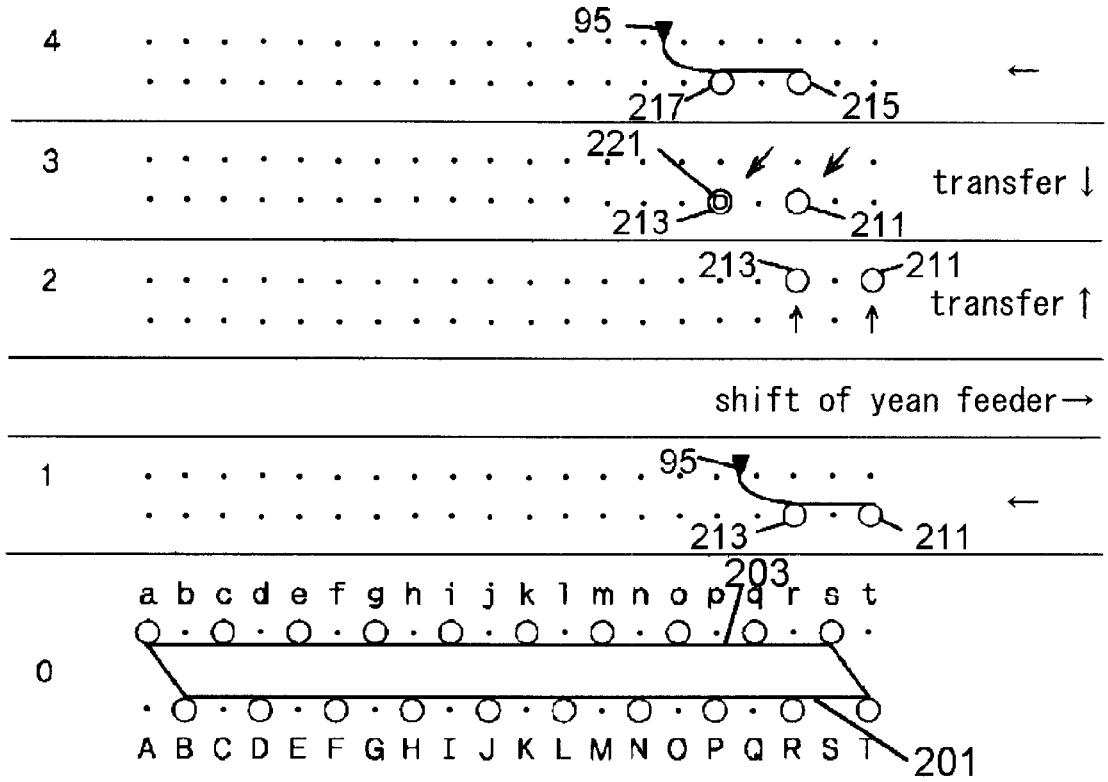
FIG. 11 is a knitting course diagram illustrating a conventional binding off method.
Figure 12:
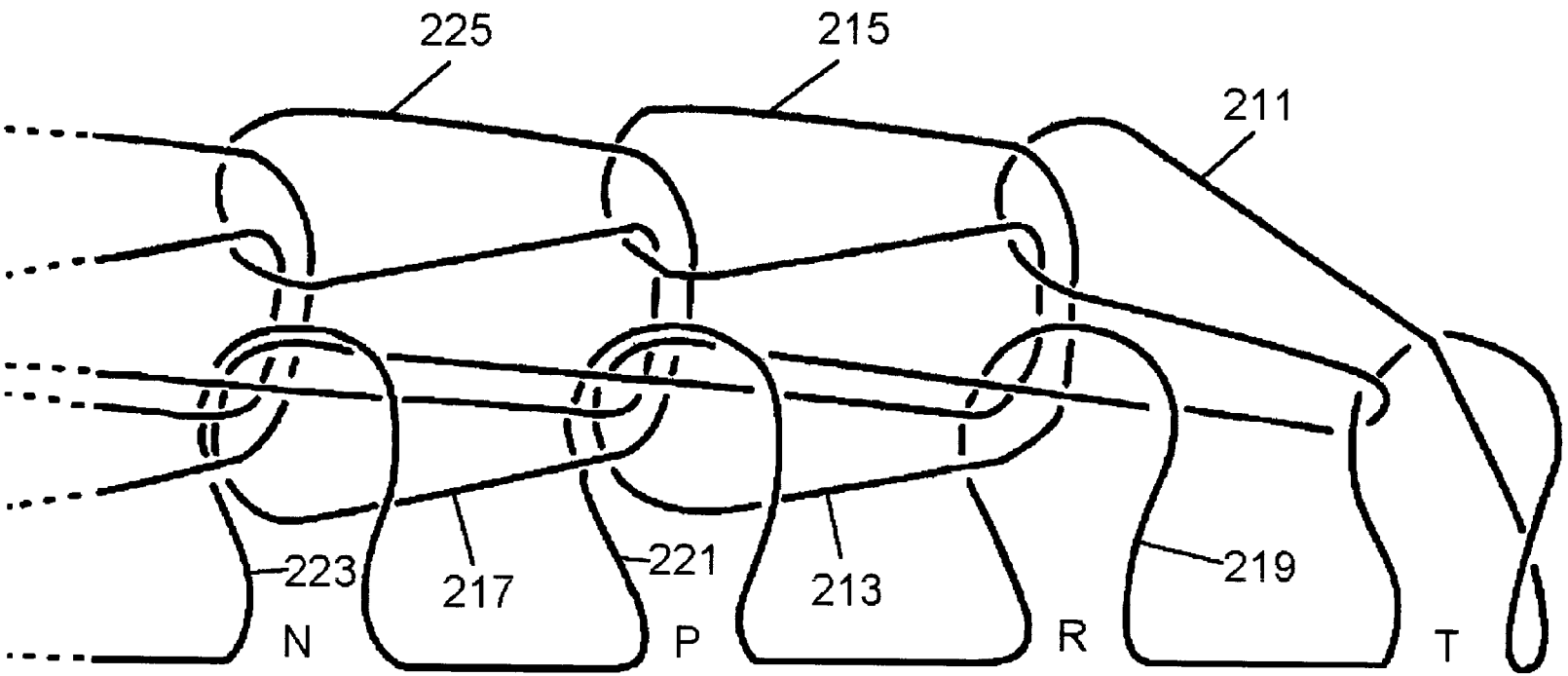
FIG. 12 is a looping diagram of the knitted fabric that was subjected to the binding off process by the conventional biding off method.

The knitted fabric that is subjected to the binding off process of the fourth embodiment comes into the state shown in the looping diagram shown in FIG. 10, which corresponds to the looping diagram of the first embodiment shown in FIG. 6, except the upstream wale loops 1B, 2B, 3B and 4B. In the first embodiment, the knitting yarn drawn from the intermediate wale loops 1-1, 1-2, 2-1 and 2-2 is drawn into both of the downstream wale loops 1A, 2A and 3A and the upstream wale loops 1B, 2B, 3B and 4B. In contrast to this, in the fourth embodiment, it is drawn into the downstream wale loops 1A, 2A and 3A only. Hence, the knitted fabric of the fourth embodiment provides a knitted fabric having more excellent stretchability, as compared with the knitted fabric of the first embodiment.

As mentioned above, in the binding off method of the present invention, the intermediate wale loops (1st, 2nd, and 3rd embodiments) or the upstream wale loops (4th embodiment), from which the yarn is drawn out when a force acts on the knitted fabric, are formed to be continuous to the downstream wale loops. Thus, two cross-over yarns extending between the downstream wale loops which are laid over the loops in the final course of the knitted fabric, and the intermediate wale loops which are formed with the number of courses twice as much as the downstream wale loops (1st, 2nd, and 3rd embodiments) or the upstream wale loops (4th embodiment), are connected to the intermediate wale loops which are formed in the different courses, respectively (1st, 2nd, and 3rd embodiments) or to the upstream wale loops (4th embodiment). This can allow the yarn drawn out from the intermediate wale loops (1st, 2nd, and 3rd embodiments) or from the upstream wale loops (4th embodiment) to be fed directly to the downstream wale loops. This can allow the downstream wale to be stretched smoothly to thereby produce the knitted fabric having an excellent stretchability.

The embodiments described above are just taken as an example of the, embodied forms. Modifications may be made in the invention, such as, for example, forming all the intermediate wale loops in the form of the back stitches, without departing from the spirit and scope of the invention.

Capabilities of Exploitation in Industry

As mentioned above, in the binding off method of the present invention, when the binding off loops are formed in the process of the binding off process, the intermediate wale loops, which are formed with the needles located between the downstream wale loops and the upstream wale loops of the binding off loops, are formed with the number of courses twice as much as the wale loops between the downstream wale loops and those between the upstream wale loops. This can provide the result that when a force acts on the knitted fabric, the yarn is drawn out from the intermediate wale loops to enlarge the downstream wale loops and the upstream wale loops. This can allow the bound off part of the knitted fabric to have an excellent stretchability.

In the case where the intermediate wale loops are transferred to the opposed needle bed in advance of the form of the same, and the loops of the next course are formed in the form of the back stitches on the opposed needle bed and then are transferred back to the original needle bed, whereby at least one course of intermediate wale loops are formed in the form of the back stitches, the cross-over yarn between the loops comes to increase in length, as compared with the case where the intermediate wale loops are all formed in the form of the front stitches. This can allow the bound off part of the knitted fabric to have an excellent stretchability to that extent.

In the case where in the wale, located upstream of the proceeding direction of the binding off process, of the two adjoining wales in the final course of the knitted fabric, two courses of loops are formed in the single binding off process; in the wale located downstream of the same, one course of loops are formed in the single binding off process; and the loops thus formed are bound off, there is provided the result that when a force acts on the knitted fabric, the knitting yarn drawn from the two course of wale loops is drawn into only the wale loops downstream of the proceeding direction of the binding off process, so that the loops are enlarged. This can allow the bound off part of the knitted fabric to have an excellent stretchability.

What is claimed is:

1. A method of binding off an end of a knitted fabric in a proceeding direction of a binding-off process in which loops are bound off from one end of the same by use of a flat knitting machine comprising at least a pair of front and back needle beds, at least one of which are structured to be racked horizontally, the method comprising:

(a) feeding a yarn to all needles holding loops in wale to be bound off in a final course of the knitted fabric in the proceeding direction of the binding-off process, except a needle holding a loop in wale located upstream of the proceeding direction, to form bind-off loops of a first course, (b) feeding the yarn to all the needles holding loops in wale to be bound off in an opposite direction to the proceeding direction, except a needle holding a loop in wale located downstream of the proceeding direction, by revering a yarn feeder, to form bind-off loops in the next course, (c) shifting the bind-off loops formed in step (a) and step (b) to the proceeding direction of the binding off process and laying a loop in wale located downstream of the proceeding direction of the binding off process over an adjoining loop in the final course of the knitted fabric, to form a double loop, and (d) performing the steps (a) to (c) repeatedly with respect to the loops in the final course of the knitted fabric formed in the proceeding direction of the binding off process, to provide stretchability for the binding off portion of the knitted fabric.

2. The binding off method according to claim 1, wherein in advance of the form of intermediate wale loops of the binding off loops from which downstream wale loops and upstream wale loops are excluded, the intermediate wale loops are transferred to an opposed needle bed, and loops of the next course are formed in the form of the back stitches on the opposed needle bed and then are transferred back to the original needle bed, whereby at least one course of intermediate wale loops are formed in the form of the back stitches.

3. A method of binding off in knitting an end of a knitted fabric by use of a flat knitting machine comprising at least a pair of front and back needle beds, at least one of which is structured to be racked horizontally, the method comprises:

(a) the step that a yarn is fed to two adjoining wale loops in a final course of a knitted fabric to be subjected to a binding off process in accordance with a proceeding direction of the binding off process, to form a first course of binding off loops, (b) the step that a yarn feeder is reversed and a bonding off loop of the next course is formed at a wale loop located upstream of the proceeding direction of the binding off process, (c) the step that the binding off loops formed in the step (a) and the step (b) are shifted to the proceeding direction of the binding off process and the wale loop located downstream of the proceeding direction of the binding off process is laid over the adjoining loop in the final course of the knitted fabric, to form a double loop, and (d) the step that the knitting of the steps (a) to (c) are repeatedly performed to the loops in the final course of the knitted fabric located in the proceeding direction of the binding off process, whereby an excellent stretchability is provided for the binding off portion of the knitted fabric.

* * * * *